US005714663A

United States Patent [19]

Serrand et al.

[11] Patent Number: 5,714,663

[45] Date of Patent: Feb. 3, 1998

[54] PROCESS FOR OBTAINING SIGNIFICANT OLEFIN YIELDS FROM RESIDUA FEEDSTOCKS

[75] Inventors: Willibald Serrand, Buxheim, Germany; Mitchell Jacobson, West Orange, N.J.; Paul K. Ladwig, Randolph, N.J.; John F. Pagel, Cedar Knolls, N.J.; Michael R. Parrish, Morristown, N.J.; Noel Seimandi; Hans A. Weisenberger, both of Brussels, Belgium

[73] Assignee: Exxon Research and Engineering Company, Florham Park, N.J.

[21] Appl. No.: 606,153

[22] Filed: Feb. 23, 1996

[51] Int. Cl.[6] ..... C07C 4/02; C10G 9/28

[52] U.S. Cl. ..... 585/648; 585/648; 208/127

[58] Field of Search ..... 208/127; 585/648

[56] References Cited

U.S. PATENT DOCUMENTS 2,768,127 10/1956 Kimberlin et al. ..... 196/55
4,985,136 1/1991 Bartholic ..... 208/153

OTHER PUBLICATIONS

H. Weiss, J. Schmalfeld. "Coking of Residue Oils by the LR–Process," Sonderdruck aus Erdol & Kohle—Erdgas—Petrochemie/Hydrocarbon Technology, 42, 235–237 (1989).

H.J. Weiss, J. Schmalfeld. "Coking of Oil Sand, Asphaltenes and Residual Oils in the LR–Process" Fourth UNITAR/UNDP Intl. Conf. on Heavy Crude & Tar Sands (paper #144), Aug. 1988 (no date).

H. Weiss, J. Schmalfeld, R.B. Solari. "Coking Oil Sands, Alsphaltenes and Residual Oils in the LR–Process":, paper at the 5th UNITAR Conference Aug. 9, 1988.

*Primary Examiner*—Glenn Caldarola
*Assistant Examiner*—Tanaga A. Boozer
*Attorney, Agent, or Firm*—Henry E. Naylor

[57] ABSTRACT

A process for obtaining a substantial amount of olefinic products from a residua feedstock by use of a short vapor contact time thermal process unit comprised of a horizontal moving bed of fluidized hot particles.

6 Claims, 1 Drawing Sheet

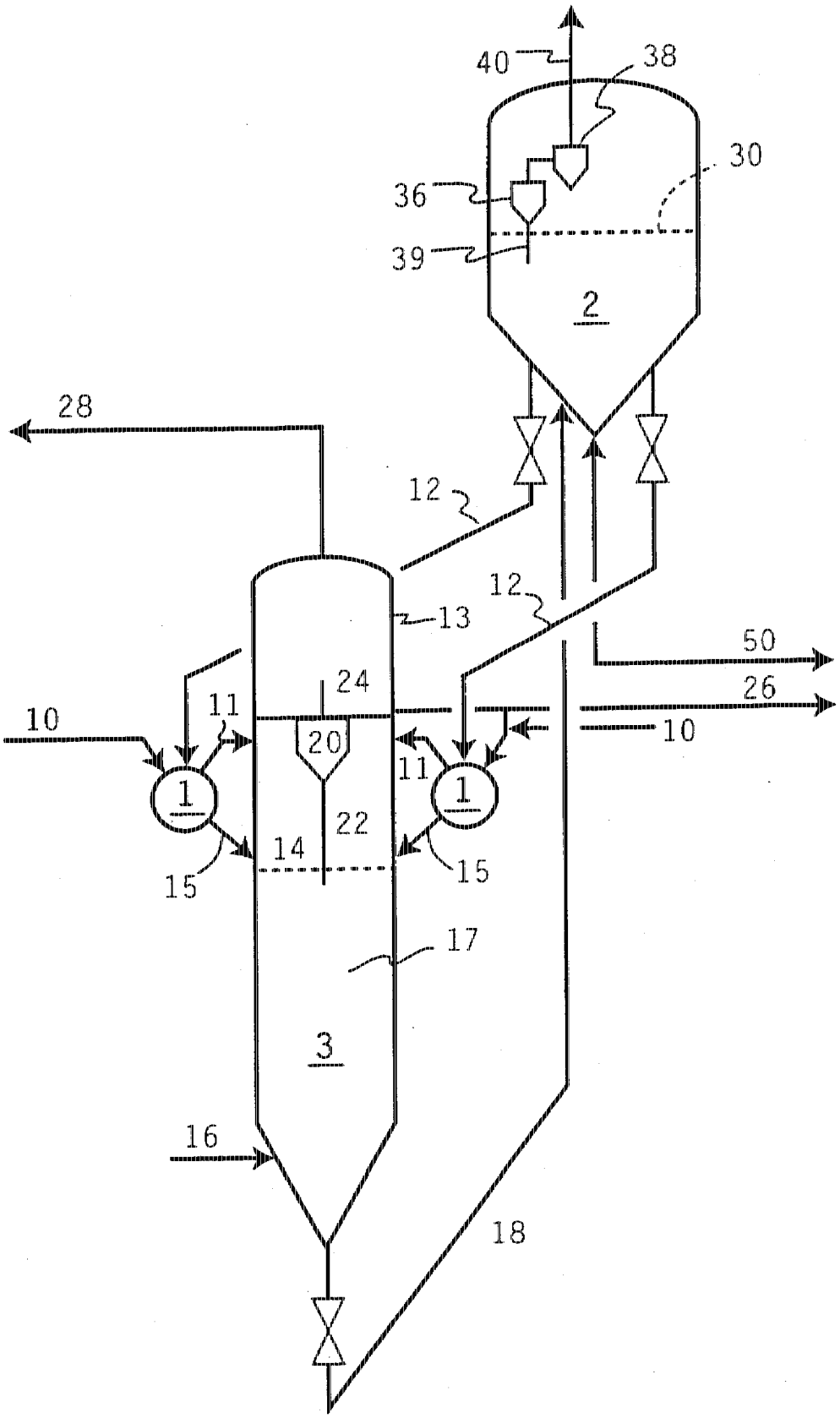
40
38
30
36
39
2
28
12
12
13
50
24
26
10
11
20
10
11
1
1
22
14
15
15
17
3
16
18

PROCESS FOR OBTAINING SIGNIFICANT OLEFIN YIELDS FROM RESIDUA FEEDSTOCKS

BACKGROUND OF THE INVENTION

The present invention relates to a process for obtaining a substantial amount of olefinic product from a residua feedstock by use of a short vapor contact time thermal process unit comprised of a horizontal moving bed of fluidized hot particles.

BACKGROUND OF THE INVENTION

In a typical refinery, crude oils are subjected to atmospheric distillation to produce lighter fractions such as gas oils, kerosenes, gasolines, straight run naphtha, etc. Petroleum fractions in the gasoline boiling range, such as naphthas, and those fractions which can readily be thermally or catalytically converted to gasoline boiling range products, such as gas oils, are the most valuable product streams in the refinery. The residue from atmospheric distillation is distilled at pressures below atmospheric pressure to produce a vacuum gas oil distillate and a vacuum reduced residual oil which often contains relatively high levels of asphaltene molecules. These asphaltene molecules typically contain most of the Conradson Carbon residue and metal components of the residua. It also contains relatively high levels of heteroatoms, such as sulfur and nitrogen. Such feeds have little commercial value, primarily because they cannot be used as a fuel oil owing to ever stricter environmental regulations. They also have little value as feedstocks for refinery processes, such as fluid catalytic cracking, because they produce excessive amounts of gas and coke. Their high metals content also leads to catalyst deactivation. Thus, there is a great need in petroleum refining for better ways to utilize residual feedstocks or to upgrade them to more valuable cleaner and lighter feeds.

Unlike residual feedstocks, more valuable feedstocks such as gas oils are used in fluid catalytic cracking to produce transportation fuels as well as being used as feedstock to make olefinic chemical products in a steam cracker. A steam cracker is a thermal process unit comprised of fired coils where the feedstock is cracked at temperatures of about 540° to 800° C. in the presence of steam. While gas oils are adequate feedstocks for such purposes, they are also relatively expensive feedstocks because they are a preferred feedstock to a fluid catalytic cracker. It would be desirable from an economic point of view to use lower valued feeds, such as residual feeds in steam cracking. Residual feedstocks are generally not suitable for use in steam crackers because of excessive cracking, coke formation, and coke deposition in the cracking coils which leads to overheating and equipment plugging. In addition, it has been found that steam can react with coke at process temperatures to form substantial amounts of CO which dilutes product vapors and seriously complicates product recovery.

An attempt to overcome these problems was made in U.S. Pat. No. 2,768,127 which teaches the use of residual feedstocks for the production of aromatic and olefinic product streams. This is accomplished by contacting the residua feedstock in a fluidized bed of coke particles maintained at a temperature from about 675° to 760° C. While such a process is useful, there remains a need for improved processes for obtaining olefinic products from residual feedstocks without excessive cracking of product vapors.

SUMMARY OF THE INVENTION

In accordance with the present invention, there is provided a process for producing olefins from a residual feedstock, which process comprises converting the feedstock in a process unit comprised of:

(i) a heating zone wherein solids containing carbonaceous deposits are received from a stripping zone and heated in the presence of an oxidizing gas;

(ii) a short vapor contact time reaction zone containing a horizontal moving bed of fluidized hot solids recycled from the heating zone, which reaction zone is operated at a temperature from about 670° C. to about 870° C. and under conditions such that the solids residence time and the vapor residence time are independently controlled, which vapor residence time is less than about 2 seconds, and which solids residence is from about 5 to about 60 seconds; and (iii) a stripping zone through which solids having carbonaceous deposits thereon are passed from the reaction zone and wherein lower boiling hydrocarbons and volatiles are recovered with a stripping gas; which process comprises:

(a) feeding the residua feedstock to said short vapor contact time reaction zone wherein it contacts the fluidized hot solids thereby resulting in high Conradson Carbon components and metal-containing components being deposited onto said hot solids, and a vaporized fraction containing olefinic products;

(b) separating the vaporized fraction from the solids; and (c) passing the solids to said stripping zone where they are contacted with a stripping gas, thereby removing volatile components therefrom;

(d) passing the stripped solids to a heating zone where they are heated to an effective temperature that will maintain the operating temperature of the reaction zone; and (e) passing hot solids from the heating zone to the reaction zone where they are contacted with fresh feedstock.

BRIEF DESCRIPTION OF THE FIGURE

The sole FIGURE hereof is a schematic flow plan of a non-limiting preferred embodiment of the present invention.

DETAILED DESCRIPTION OF THE INVENTION

Residual feedstocks which are suitable for use in the present invention are those petroleum fractions boiling above about 480° C., preferably above about 540° C., more preferably above about 560° C. Non-limiting examples of such fractions include vacuum resids, atmospheric resids, heavy and reduced petroleum crude oil; pitch; asphalt; bitumen; tar sand oil; shale oil; coal; coal slurries; and coal liquefaction bottoms. It is understood that such residual feedstocks may also contain minor amounts of lower boiling material. These feedstocks typically cannot be used as feeds to steam crackers to produce olefinic products because they excessively coke. Such feeds will typically have a Conradson carbon content of at least 5 wt. %, generally from about 5 to 50 wt. %. As to Conradson carbon residue, see ASTM Test D189-165.

Olefinic products are produced from the residual feedstocks in accordance with the present invention in a short vapor contact time process unit which is comprised of a heating zone, a short vapor contact time horizontal fluidized bed reaction zone and a stripping zone. Reference is now made to the sole FIGURE hereof wherein a residual feedstock is fed via line 10 to one or more short vapor contact time reaction zones 1 which contains a horizontal moving bed of fluidized hot solids. It is preferred that the solids in the short vapor contact time reactor be fluidized with assistance by a mechanical means. The particles are fluidized by use of a fluidizing gas, such as steam, a mechanical means, and by the vapors which result in the vaporization of a fraction of the feedstock. It is preferred that the mechanical means be a mechanical mixing system characterized as having a relatively high mixing efficiency with only minor amounts of axial backmixing. Such a mixing system acts like a plug flow system with a flow pattern which ensures that the residence time is nearly equal for all particles. The most preferred mechanical mixer is the mixer referred to by Lurgi AG of Germany as the LR-Mixer or LR-Flash Coker which was originally designed for processing oil shale, coal, and tar sands. The LR-Mixer consists of two horizontally oriented rotating screws which aid in fluidizing the particles. Although it is preferred that the solid particles be coke particles, they may also be any other suitable refractory particulate material. Non-limiting examples of such other suitable refractory materials include those selected from the group consisting of silica, alumina, zirconia, magnesia, mullite, synthetically prepared or naturally occurring material such as pumice, clay, kieselguhr, diatomaceous earth, bauxite, and the like. It is within the scope of the present invention that the solids can be inert or have catalytic properties. The solids will have an average particle size of about 40 microns to 2,000 microns, preferably from about 50 microns to about 800 microns.

When the feedstock is contacted with the fluidized hot solids, which will preferably be at a temperature from about 670° C. to about 870° C., more preferably from about 700° C. to 800° C., a substantial portion of the high Conradson Carbon and metal-containing components will deposit on the hot solid particles in the form of high molecular weight carbon and metal moieties. The remaining portion will be vaporized on contact with the hot solids. This vaporized portion will contain a substantial amount of olefinic products, typically in the range of about 20 to 50 wt. %, preferably from about 25 to 50 wt. %, and more preferably from about 30 to 50 wt. %, based on the total weight of the product stream. The olefin portion of the product stream obtained by the practice of the present invention will typically be comprised of about 5 to 15 wt. %, preferably about 7 to 10 wt. % methane; about 10 to 20 wt. %, preferably about 12 to 18 wt. % ethylene; and about 5 to 15 wt. %, preferably 7 to 12 wt. % propylene, based on the feed.

The residence time of vapor products in reaction zones 1 will be an effective amount of time so that substantial secondary cracking does not occur. This amount of time will typically be less than about 2 seconds, preferably less than about 1 second, and more preferably less than about 0.5 seconds. The residence time of solids in the reaction zone will be from about 5 to 60 seconds, preferably from about 10 to 30 seconds. One novel aspect of the present invention is that the residence time of the solids and the residence time of the vapor products, in the reaction zone, are independently controlled. Most fluidized bed processes are designed so that the solids residence time, and the vapor residence time cannot be independently controlled, especially at relatively short vapor residence times. It is preferred that the short vapor contact time process unit be operated so that the ratio of solids to feed be from about 30 to 1, preferably 20 to 1, more preferably about 10 to 1, and most preferably from about 5 to 1. It is to be understood that the precise ratio of solids to feed will primarily depend on the heat balance requirement of the short vapor contact time reaction zone. Associating the oil to solids ratio with heat balance requirements is within the skill of those having ordinary skill in the art, and thus will not be elaborated herein any further. A minor amount of the feedstock will deposit on the solids in the form of combustible carbonaceous material. Metal components will also deposit on the solids. Consequently, the vaporized portion will be substantially lower in both Conradson Carbon and metals when compared to the original feed.

The vaporized fraction is passed via line 11 to cyclone 20 where most of the entrained solids, or dust, is removed. The dedusted vapors are then passed to quench zone 13 via line 24 where the vapors are reduced to temperatures below which substantial thermal cracking occurs. This temperature will preferably be below about 450° C., more preferably below about 340° C. Solids, having carbonaceous material deposited thereon, are passed from reaction zones 1 via lines 15 to the bed of solids 17 in stripper 3. The solids pass downwardly through the stripper and past a stripping zone at the bottom section where any remaining volatiles, or vaporizable material, are stripped from the solids with use of a stripping gas, preferably steam, introduced into the stripping zone via line 16. Stripped vapor products pass upwardly in stripper vessel 3, through line 22 to cyclone 20 to quench zone 13 via line 24 where a light product, containing a substantial amount of olefins, is removed overhead via line 28. The light product will typically be a 510° C. minus product stream. This 510° C. minus product stream will typically contain about 7 to 10 wt. % methane, 12 to 18 wt. % ethylene, and 7 to 12 wt. % propylene, and 6 to 9 wt. % unsaturated $C_4$'s, such as butanes and butadienes, based on the total weight of the feed.

A 510° C. plus stream will be collected from the quench zone via line 26. The stripped solids are passed via line 18 to heater 2 which contains a heating zone. The heating zone is operated in an oxidizing gas environment, preferably air, at an effective temperature. That is, at a temperature that will meet the heat requirements of the reaction zone. The heating zone will typically be operated at a temperature of about 40° C. to 200° C., preferably from about 65° C. to 175° C., more preferably from about 65° C. to 120° C. in excess of the operating temperature of reaction zones 1.

It is understood that preheated air can be introduced into the heater. The heater will typically be operated at a pressure ranging from about 0 to 150 psig, preferably at a pressure ranging from about 15 to about 45 psig. While some carbonaceous residue will be burned from the solids in the heating zone, it is preferred that only partial combustion take place so that the solids, after passing through the heater, will have value as a fuel. Excess solids can be removed from the process unit via line 50. Flue gas is removed overhead from heater 2 via line 40. The flue gas is passed through a cyclone system 36 and 39 to remove most solid fines. Dedusted flue gas will be further cooled in a waste heat recovery system (not shown), scrubbed to remove contaminants and particulates, and passed to a CO boiler (not shown). The hot inert solids are then recycled via lines 12 to thermal zone 1.

The following example is presented to show that a short contact time process mode is important for obtaining increased olefin yields from residual feedstocks.

EXAMPLE

A South Louisiana Vacuum Residua was used as the feedstock and was fed at a feedrate of 100 barrels/day to a short contact time fluid coking pilot unit. The operating temperature of the pilot unit was 745° F. at a vapor residence time of less than 1 second. Estimated conversion and product yields are set forth in Table I below.

TABLE I

| | |
|---|---|
| Feedrate | 100 |
| Temperature °C. | 745 |
| $C_3^-$ Conversion | 35 |
| Gas Yields wt. % on Feed | |
| Methane | 7–10 |
| Ethylene | 14–16 |
| Propylene | 9–12 |
| Unsaturated $C_4$'s | 6–9 |
| Liquid Yields wt. % on Feed | |
| $C_5$/220° C. | 17.5 |
| 220°/340° C. | 8.0 |
| 340° C.$^+$ | 13.0 |
| Total $C_5^+$ | 38.5 |
| Gross Coke, wt. % on Feed | 18.7 |
| Ethylene/Ethane | 6.0 |
| Propylene/Propane | 19.0 |
| Butylene/Butane | 30.0 |

What is claimed is:

1. A process for producing olefins from a residual feedstock, which process comprises converting the feedstock in a process unit comprised of:

(i) a heating zone wherein solids containing carbonaceous deposits are received from a stripping zone and heated in the presence of an oxidizing gas;

(ii) a short vapor contact time reaction zone containing a horizontal moving bed of fluidized hot solids recycled from the heating zone, which reaction zone is operated at a temperature from about 670° C. to about 870° C. and operated under conditions such that substantially all of the solids that are passed from the heating zone pass through the reaction zone and wherein the solids residence time in from about 5 to about 60 seconds, and the vapor residence time is less than about 1 seconds; and (iii) a stripping zone through which solids having carbonaceous deposits thereon are passed from the reaction zone and wherein lower boiling additional hydrocarbon and volatiles are recovered with a stripping gas; which process comprises:

(a) feeding the residua feedstock, in liquid form, to the short vapor contact time reaction zone wherein it contacts the fluidized hot solids thereby resulting in high Conradson Carbon components and metal-containing components being deposited onto said hot solids, and a vaporized fraction containing olefinic products;

(b) separating the vaporized fraction from the solids; and (c) passing the solids to said stripping zone where they are contacted with a stripping gas, thereby removing volatile components therefrom;

(d) passing the stripped solids to a heating zone where they are heated to an effective temperature that will maintain the operating temperature of the reaction zone; and (e) recycling hot solids from the heating zone to the reaction zone such that substantially all of the solids that are passed from the heating zone pass through the reaction zone and where they are contacted with fresh feedstock.

2. The process of claim 1 wherein the residua feedstock is selected from the group consisting of vacuum resids, atmospheric resids, heavy and reduced petroleum crude oil; pitch; asphalt; bitumen; tar sand oil; shale oil; and coal liquefaction bottoms.

3. The process of claim 2 wherein the residua feedstock is a vacuum resid.

4. The process of claim 1 wherein the solids residence time of the short vapor contact time reaction zone is from about 10 to 30 seconds.

5. The process of claim 1 wherein the particles of the short vapor contact time reaction zone are fluidized with the aid of a mechanical means.

6. The process of claim 5 wherein the mechanical means are comprised of set of horizontally disposed screws within the reactor.

* * * * *